US011382422B1

(12) United States Patent
Gatski et al.

(10) Patent No.: US 11,382,422 B1
(45) Date of Patent: Jul. 12, 2022

(54) OVERHEAD STORAGE SYSTEM AND APPARATUS CONFIGURED TO RAISE AND LOWER

(71) Applicants: Frank Gatski, Las Vegas, NV (US); Dwayne Dunseath, Las Vegas, NV (US)

(72) Inventors: Frank Gatski, Las Vegas, NV (US); Dwayne Dunseath, Las Vegas, NV (US)

( * ) Notice: Subject to any disclaimer, the term of this patent is extended or adjusted under 35 U.S.C. 154(b) by 0 days.

(21) Appl. No.: 16/801,024

(22) Filed: Feb. 25, 2020

Related U.S. Application Data

(60) Provisional application No. 62/810,300, filed on Feb. 25, 2019.

(51) Int. Cl.

| | |
|---|---|
| ***A47B 46/00*** | (2006.01) |
| ***A47F 5/08*** | (2006.01) |
| ***A47B 43/00*** | (2006.01) |
| *A47B 51/00* | (2006.01) |

(52) U.S. Cl.
CPC ..... *A47B 46/00* (2013.01); *A47B 43/003* (2013.01); *A47F 5/0892* (2013.01); *A47B 2051/005* (2013.01)

(58) Field of Classification Search
CPC . A47B 46/00; A47B 43/003; A47B 2051/005; A47B 9/02; A47F 5/0892
See application file for complete search history.

(56) References Cited

U.S. PATENT DOCUMENTS 530,120 A * 12/1894 Oakley ..... E06C 1/34 182/116
636,445 A * 11/1899 McCabe et al. ..... B66F 7/065 187/269
2,435,755 A * 2/1948 Schimpff ..... A47F 10/00 186/53
2,792,944 A * 5/1957 Drommer ..... A47B 9/02 108/106
2,933,198 A * 4/1960 Firestone ..... A61B 6/102 212/319
5,261,645 A * 11/1993 Huffman ..... E04B 9/003 248/277.1
5,503,368 A * 4/1996 Torres ..... B66F 7/0608 254/122

(Continued)

*Primary Examiner* — Ko H Chan
(74) *Attorney, Agent, or Firm* — FisherBroyles, LLP; Rob L. Phillips

(57) ABSTRACT

An overhead storage system may be raised and lowered includes a pair of spaced scissor mechanisms, each scissor mechanism having a first rotatable point of attachment to the platform and a second translatable point of attachment to the platform, and a spring-biased tensioner mechanism configured to maintain the platform in an elevated state when access to the stored items is not desired and a lowered state when access to the stored items is desired, the spring-biased tensioner mechanism configured to allow a human to manually lower the platform from the elevated state to the lowered state and manually raise the platform from the lowered state to the elevated state. The overhead storage system detailed herein allows a user to easily access stored items without having to climb a ladder by permitting the platform of the overhead storage apparatus to be raised and lowered manually.

6 Claims, 19 Drawing Sheets

(56) References Cited

U.S. PATENT DOCUMENTS

| | | | | |
|---|---|---|---|---|
| 7,413,056 | B2 * | 8/2008 | Gonzi | B66F 7/065 187/269 |
| 8,162,159 | B2 * | 4/2012 | Carter | B66F 11/00 211/117 |
| 8,651,294 | B2 * | 2/2014 | Mansor | D06F 57/125 211/117 |
| 8,740,191 | B2 * | 6/2014 | Litcher | B66F 3/22 254/122 |
| 9,630,819 | B2 * | 4/2017 | Ong | B66F 7/0625 |
| 2007/0029267 | A1 * | 2/2007 | Hall | B62H 3/12 211/17 |
| 2008/0238278 | A1 * | 10/2008 | Jeong | F25D 25/025 312/404 |
| 2009/0255889 | A1 * | 10/2009 | Geffe | B66F 7/02 211/113 |
| 2013/0084158 | A1 * | 4/2013 | Evans | B66F 7/0641 414/800 |
| 2014/0346268 | A1 * | 11/2014 | Feldstein | B65H 75/4439 242/397.5 |

* cited by examiner

OVERHEAD STORAGE SYSTEM AND APPARATUS CONFIGURED TO RAISE AND LOWER

CROSS-REFERENCE

This application claims priority to U.S. Patent Application No. 62/810,300 filed Feb. 25, 2019 and which is incorporated herein for all purposes.

FIELD OF THE INVENTION

The embodiments of the present invention relate to an overhead storage system configured for attachment to a ceiling or similar rigid structure.

BACKGROUND

Storage space in homes is always in short supply. The same is true of garage space. Indeed, many garages are now used to store personnel belongings other than automobiles. The area near the ceilings of homes, garages and other structures is vastly underutilized. And when it is used, accessing the stored items is challenging.

It would be advantageous to develop an overhead storage apparatus that provides easy and convenient access to the items stored thereon. Moreover, the overhead storage apparatus should be economical.

SUMMARY

Accordingly, one embodiment of the present invention involves a platform, a pair of spaced scissor mechanisms, each scissor mechanism having a first rotatable point of attachment to said platform and a second translatable point of attachment to said platform, and a spring-biased tensioner mechanism configured to maintain said platform in an elevated state when access to said stored items is not desired and a lowered state when access to said stored items is desired, said spring-biased tensioner mechanism configured to allow a human to manually lower said platform from said elevated state to said lowered state and manually raise said platform from said lowered state to said elevated state.

The embodiments of the present invention allow a user to easily access the stored items without having to climb a ladder by permitting the platform of the overhead storage apparatus to be raised and lowered manually. When lowering the platform and items placed thereon, the user need only overcome the upward force of the spring-biased tensioner mechanism maintaining the platform in an elevated state. In one embodiment, the desired upward force may be set at between 30 to 40 pounds allowing almost any user to lower the platform. Raising the platform is just as easy albeit requiring a modest lifting force by the user.

Other variations, embodiments and features of the present invention will become evident from the following detailed description, drawings and claims.

BRIEF DESCRIPTION OF THE DRAWINGS

FIGS. 7A through 7I illustrate various views of a second embodiment of an overhead storage apparatus according to the embodiments of the present invention.

DETAILED DESCRIPTION

Figure 1:
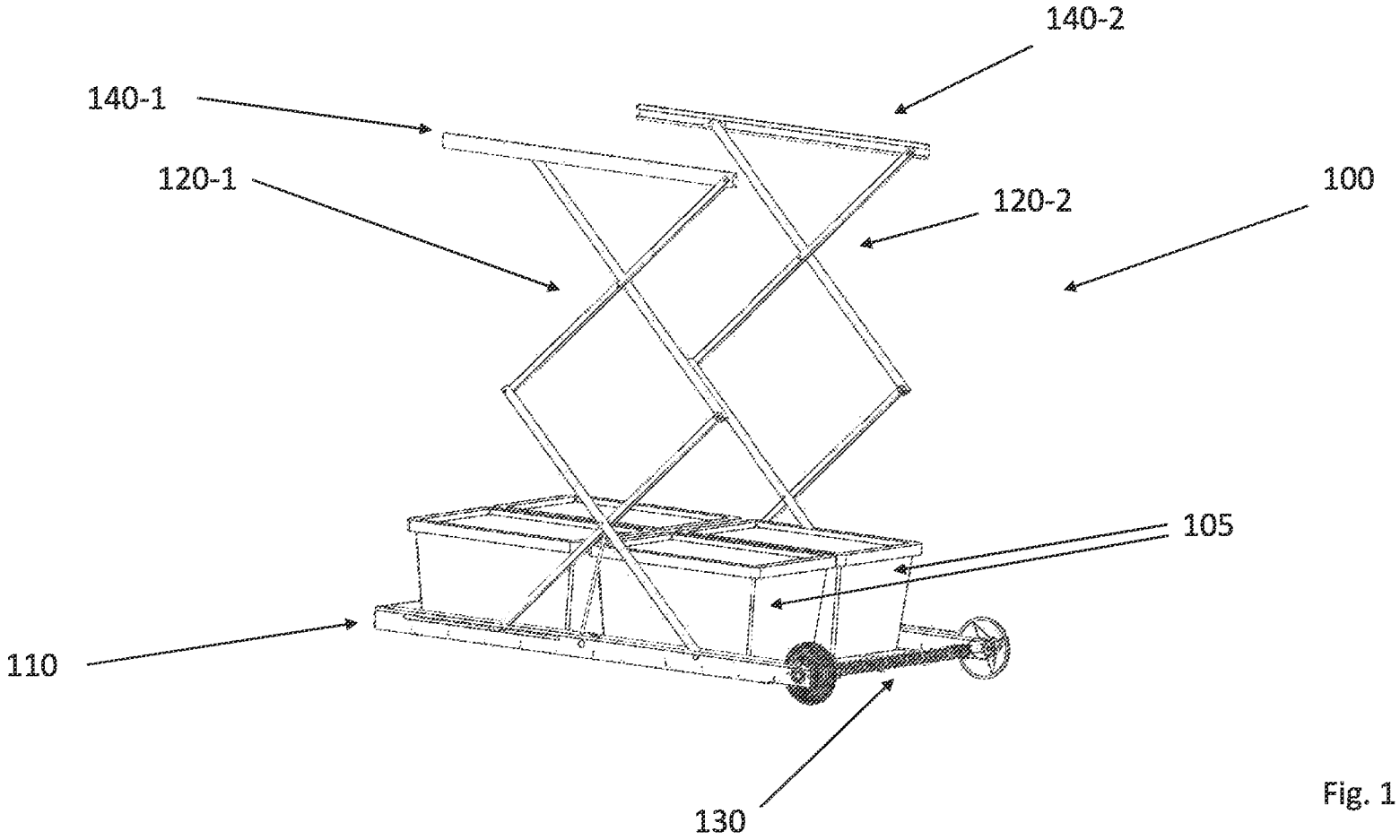
FIG. 1 illustrates a first embodiment of an overhead storage apparatus in a lowered state with storage bins thereon according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Figure 2:
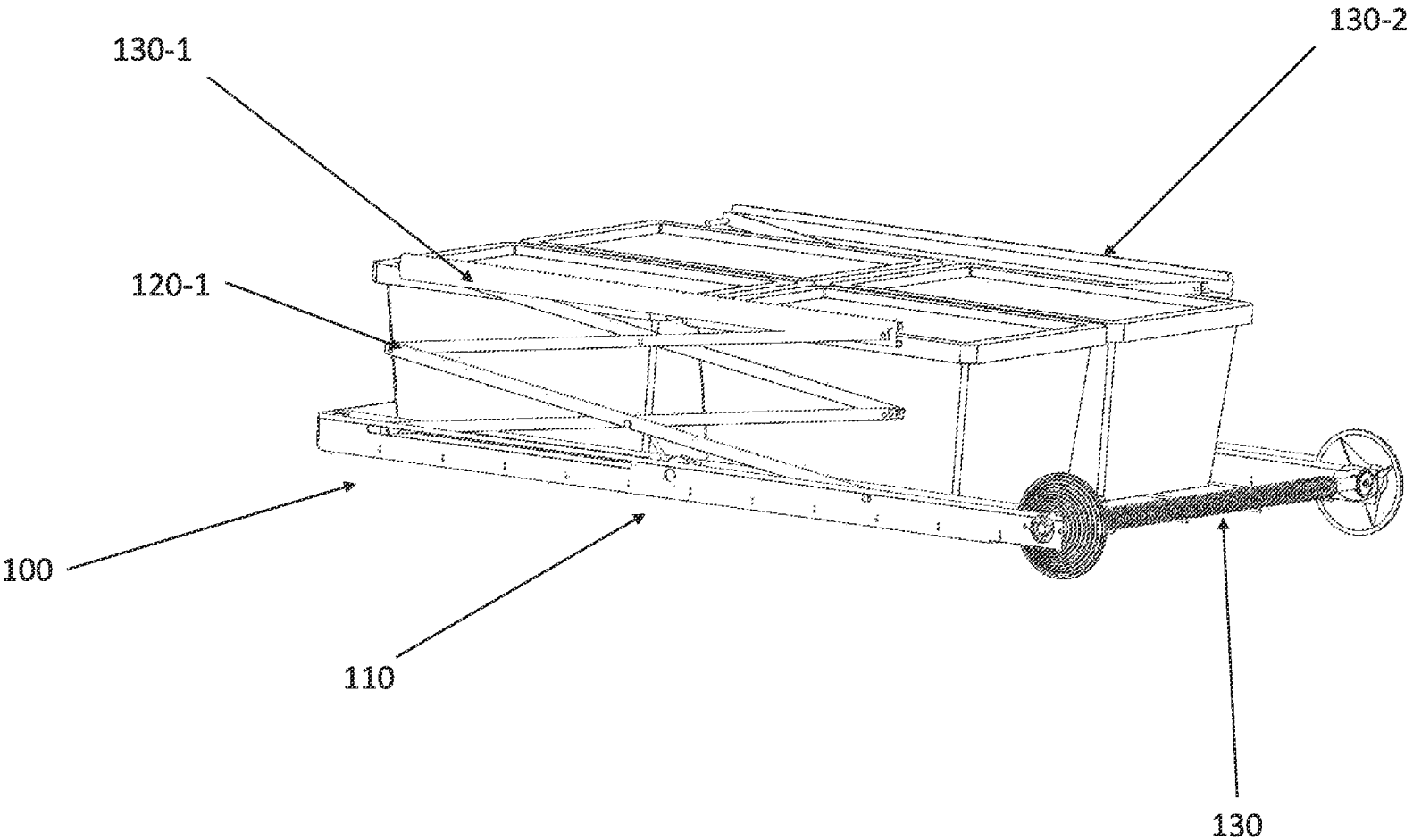
FIG. 2 illustrates the first embodiment of the overhead storage apparatus in an elevated state with storage bins thereon according to the embodiments of the present invention.

FIG. 1 shows an overhead storage apparatus 100 in a lowered state with storage bins 105 thereon according to the embodiments of the present invention. In broad terms, the overhead storage apparatus 100 comprises a platform 110, a pair of spaced scissor mechanisms 120-1, 120-2 and pulley and spring-biased tensioner mechanism 130. A pair of supports 140-1, 140-2 are configured to attach the overhead storage apparatus 100 to a rigid structure (e.g., ceiling, rafters, etc.). FIG. 2 shows the overhead storage apparatus 100 in an elevated state. In the elevated state, the bins 105 are adjacent to the ceiling or other structure to which the overhead storage apparatus 100 is attached thereby maintaining the bins or other stored items in an overhead area.

Figure 3:
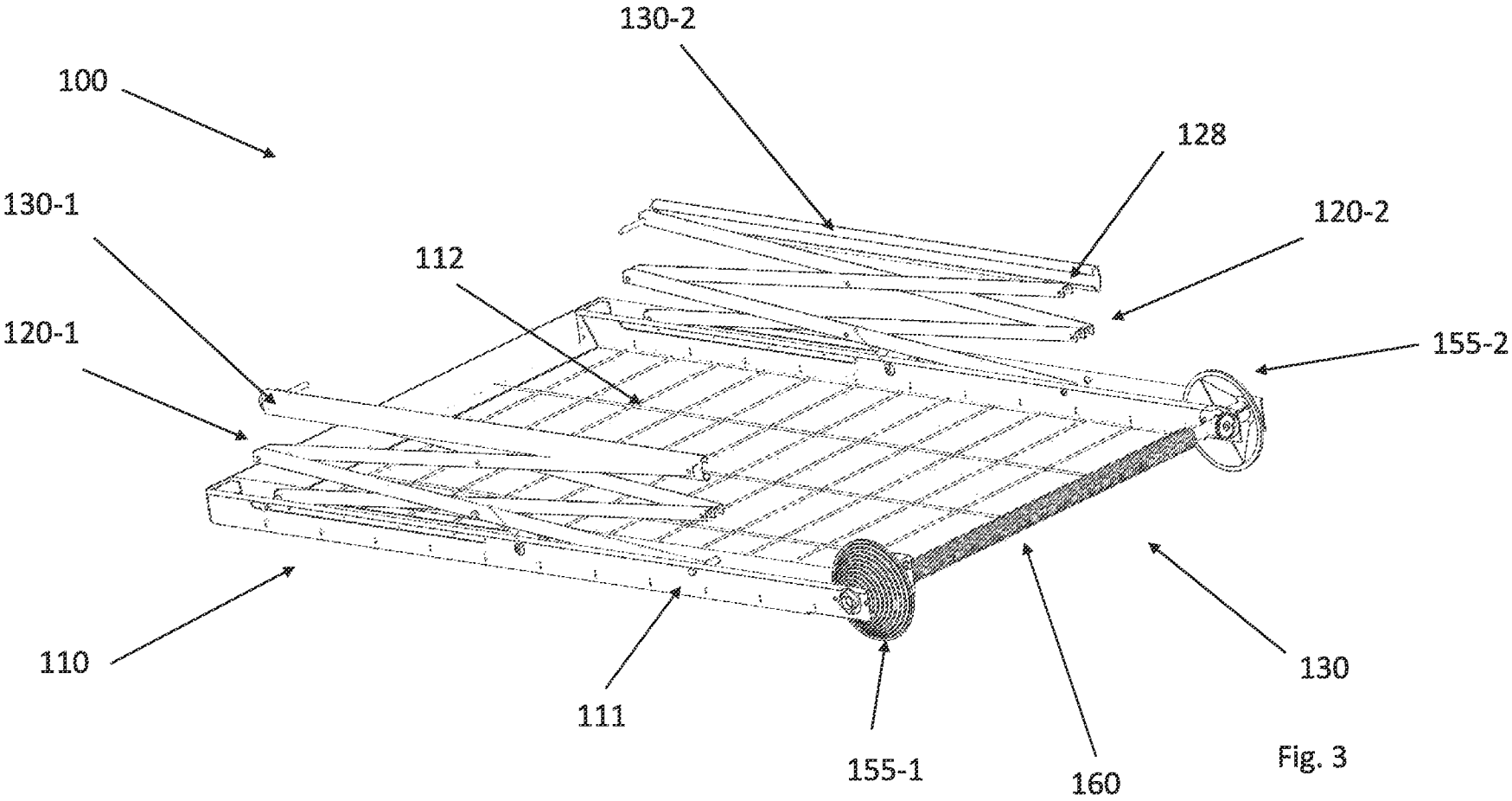
FIG. 3 illustrates the first embodiment of the overhead storage apparatus in a partially lowered state according to the embodiments of the present invention.
Figure 4:
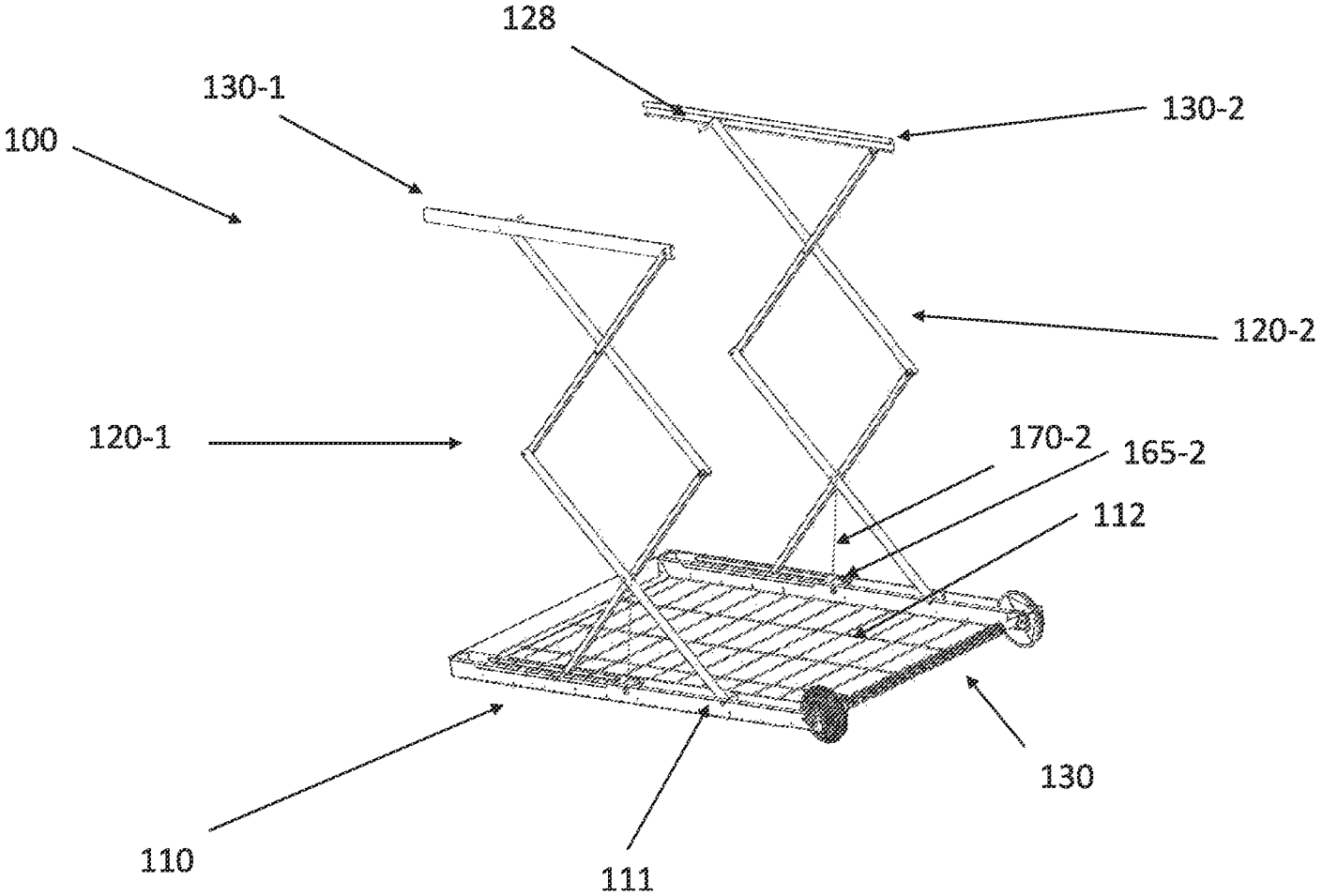
FIG. 4 illustrates the first embodiment of the overhead storage apparatus in a lowered state according to the embodiments of the present invention.

FIG. 3 shows the overhead storage apparatus 100 in an elevated state with no storage bins. FIG. 4 shows the storage apparatus 100 in a lowered state with no storage bins. As best seen in FIGS. 3 and 4, the platform 110 may comprises a frame 111 and floor 112 arrangement. As shown, the floor 112 is a grid configuration allowing the storage bins 105 to be viewed from beneath. With transparent storage bins users may prefer to view the storage bins 105 to determine items stored therein. Similarly, with opaque storage bins users may mark the bottom of the storage bins indicating items stored therein. Alternatively, the floor 112 may a solid member.

Each of the pair of spaced scissor mechanisms 120-1, 120-2 is connected at one end to one of the supports 130-1, 130-2 and connected at a second end to the frame 111 of the platform 110. Those skilled in the art will recognize that other structural members may be integrated between connection points of the pair of spaced scissor mechanisms 120-1, 120-2 and the pair of supports 130-1, 130-2 and the frame 111 of the platform 110.

Figure 6A:
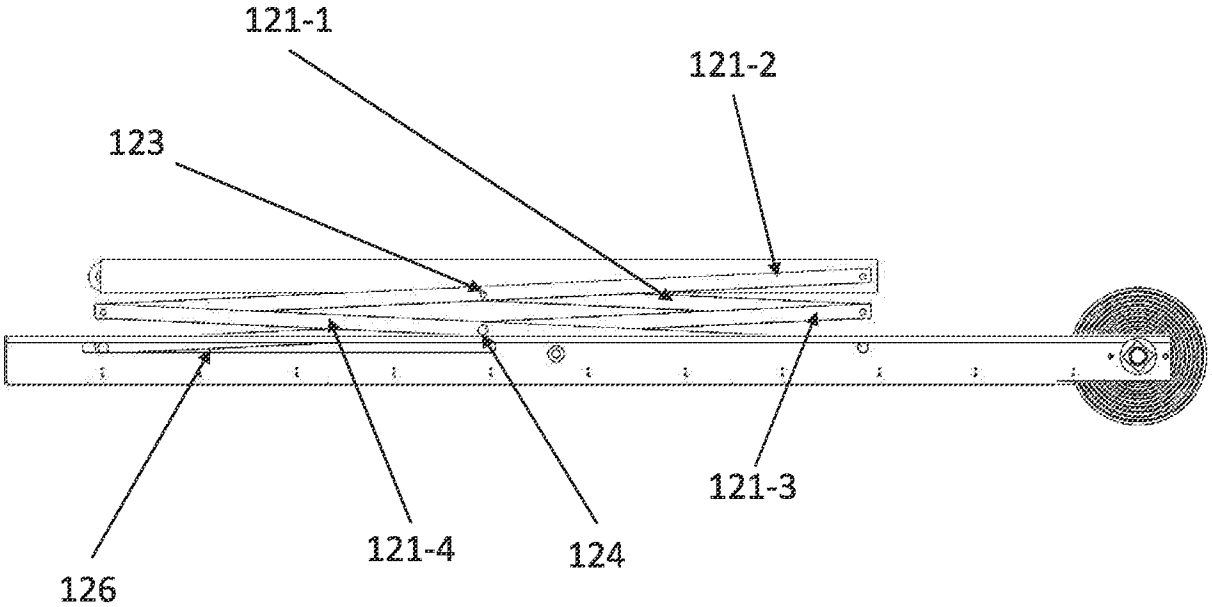
FIGS. 6A through 6C illustrate side views of the first embodiment of the overhead storage apparatus in an elevated state, lowered state and partially lowered state, respectively, according to the embodiments of the present invention.
Figure 6B:
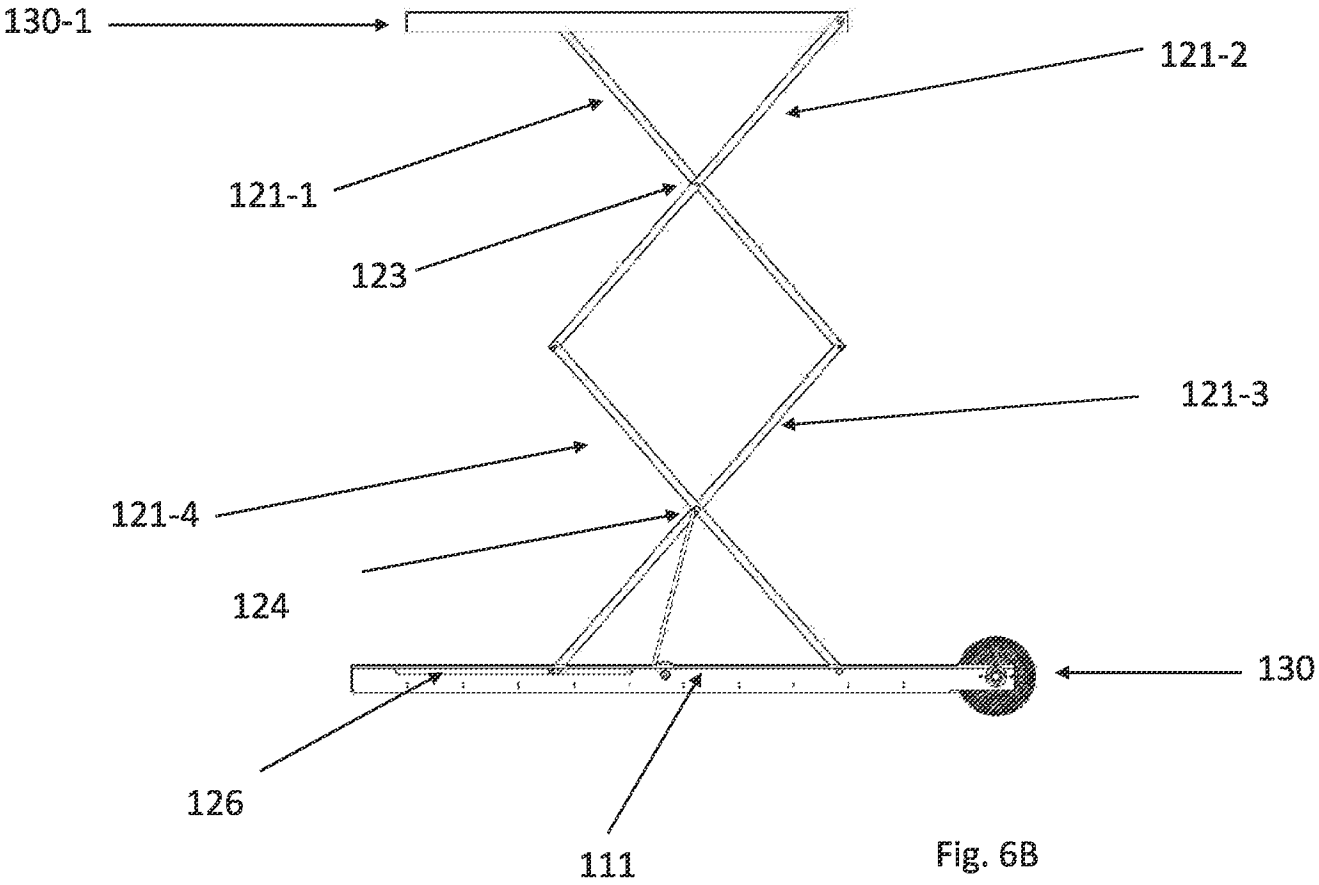
Figure 6C:
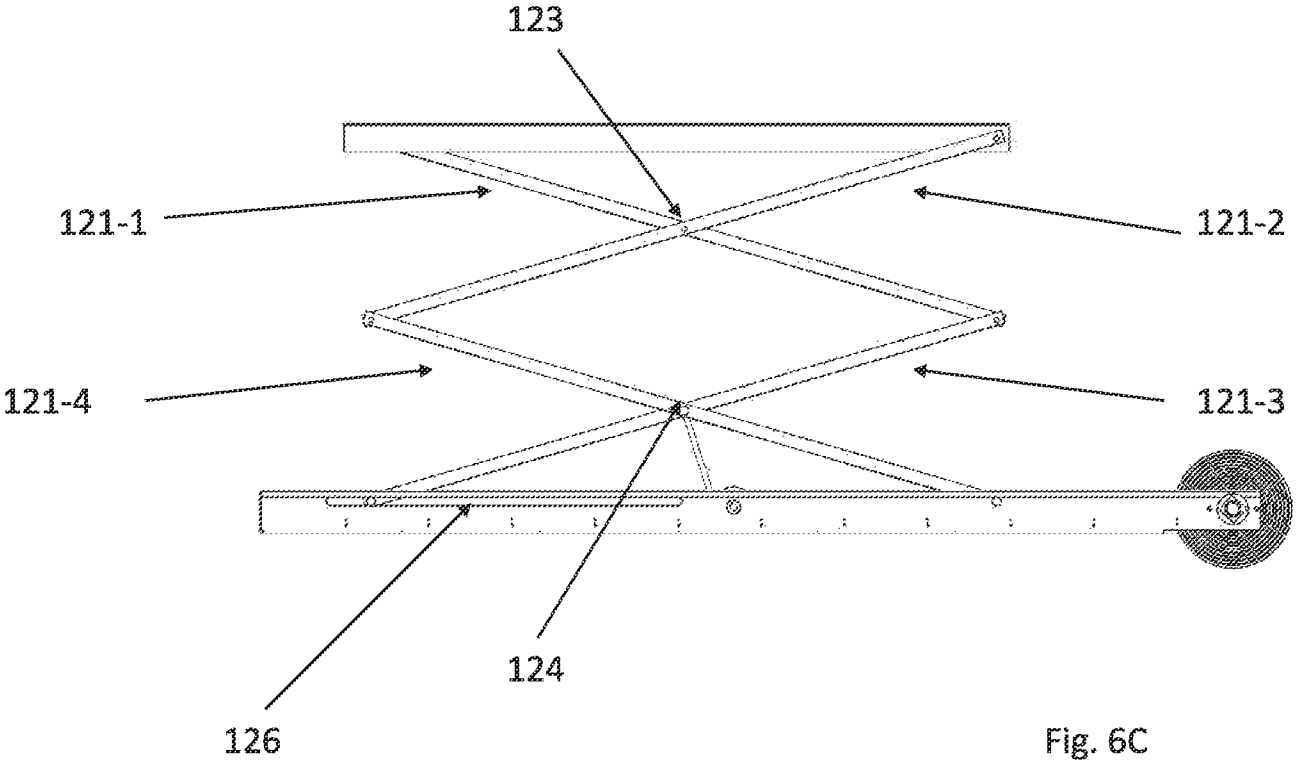

As shown in FIGS. 6A through 6B, each scissor mechanism 120-1, 120-2 comprises four arm members 121-1 through 121-4 and 122-1 through 122-4. Arm members 121-1 and 121-2 are connected at first ends to support member 130-1 and rotatably connected at second ends to arm members 121-3 and 122-4, respectively. Mid-points of arm members 121-1 and 121-2 are also rotatably connected to one another in a cross configuration. Arm members 121-3 and 122-4 are rotatably connected at first ends to arm members 121-1 and 121-2, respectively, and connected at second ends to frame 111. Mid-points of arm members 121-3 and 121-4 are also rotatably connected to one another in a cross configuration. Arm members 121-1 and 121-3 are slidably connected to said support member 130-1 and frame 111, respectively, while arm members 121-2 and 121-4 are rotatably connected to said support member 130-1 and frame 111, respectively. Arm members 122-1 through 122-4 are arranged in the same fashion.

Figure 5A:
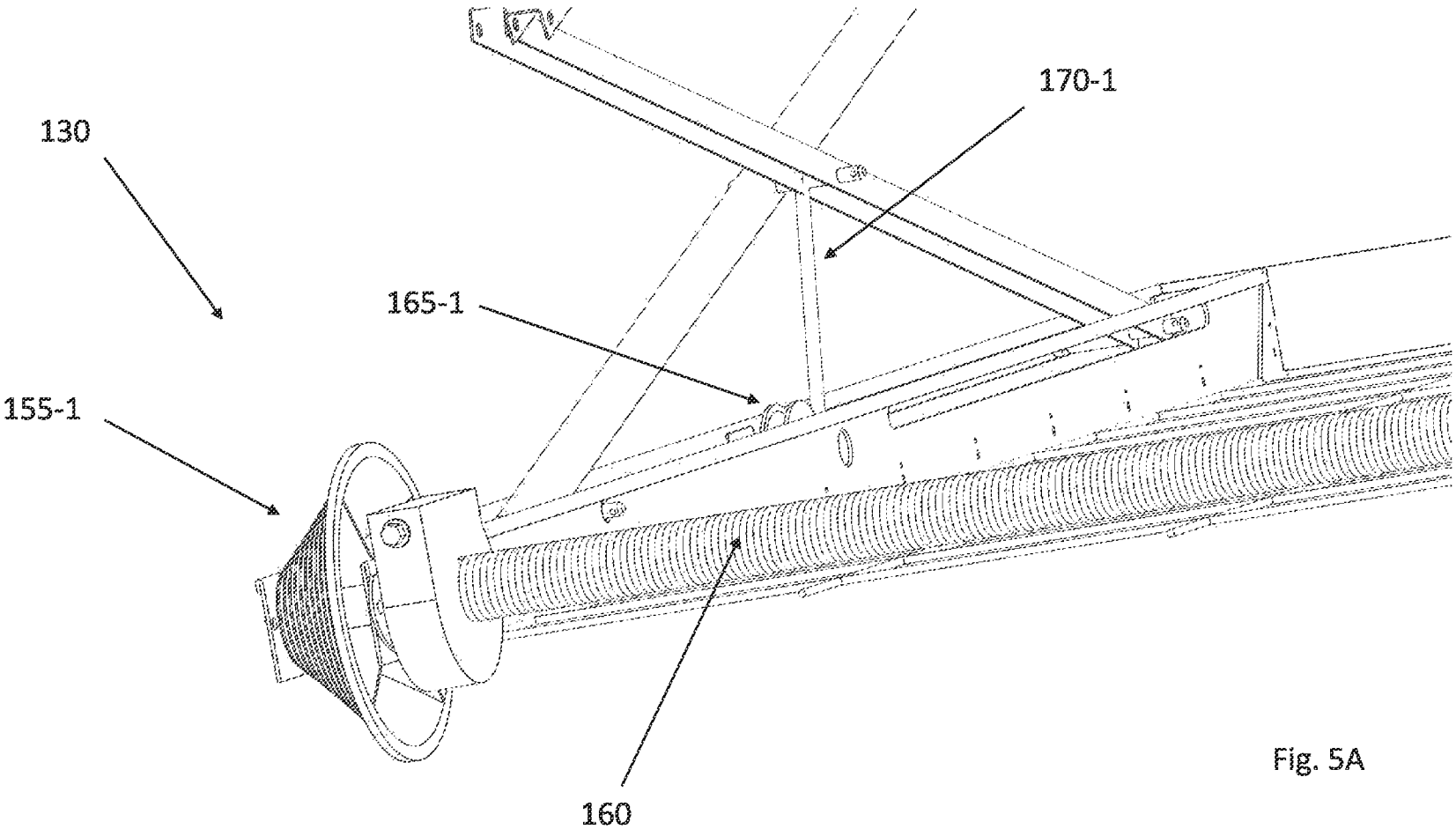
FIGS. 5A through 5C illustrate a spring-biased tensioner mechanism according to the first embodiment of the present invention.
Figure 5B:
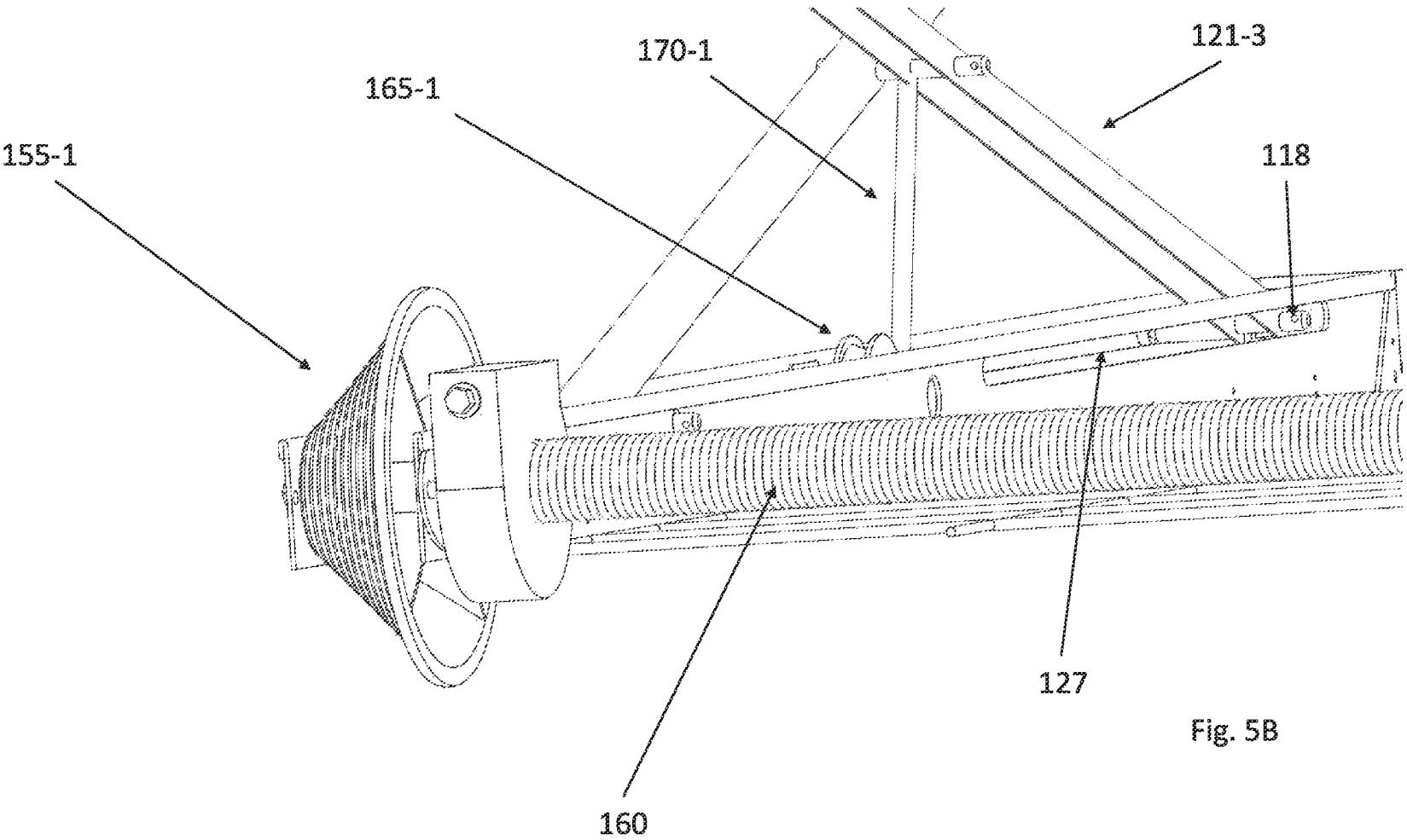
Figure 5C:
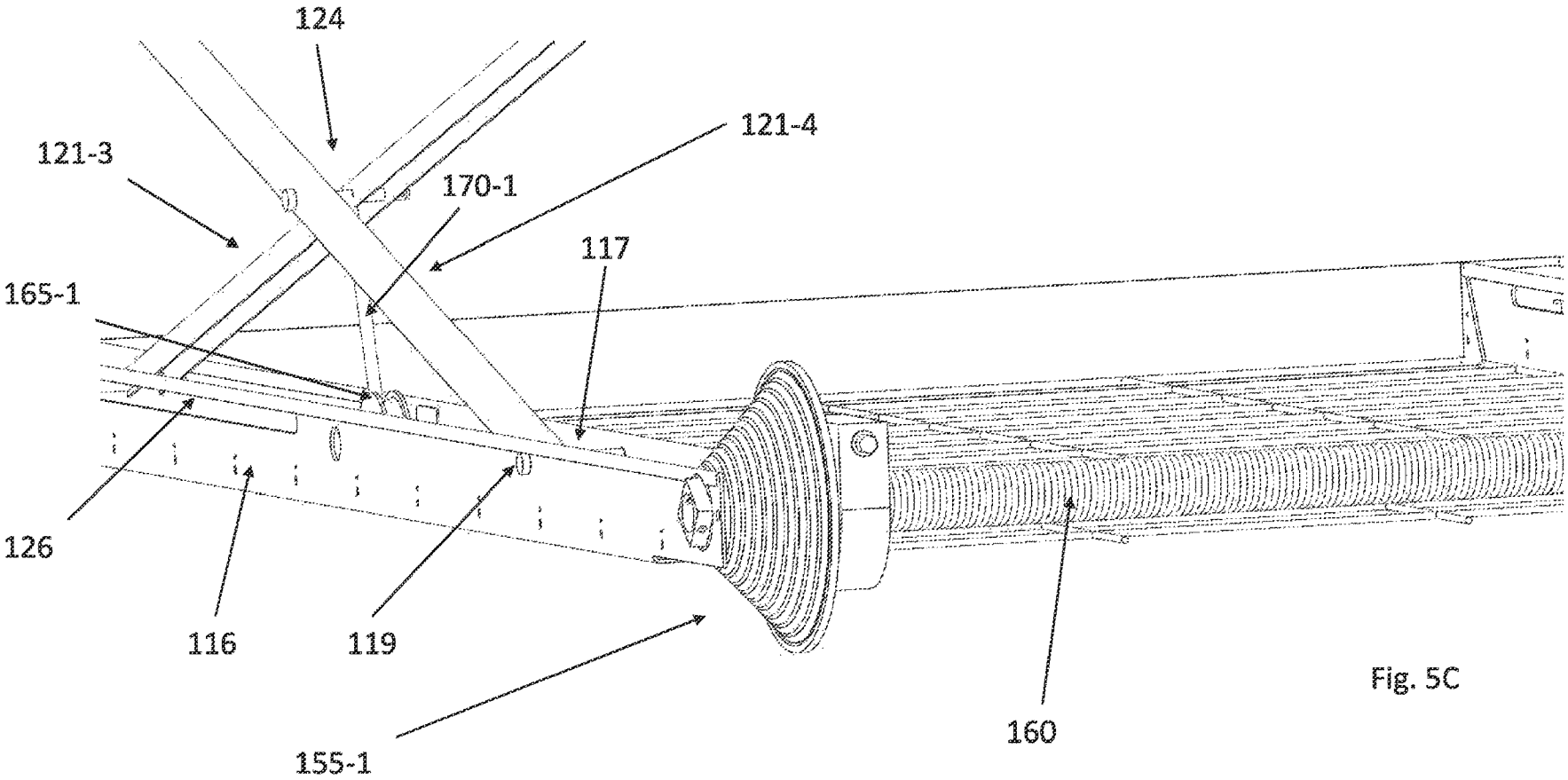

FIGS. 5A through 5C show the frame 111 comprising an outer wall 116 and inner wall 117 in which pins 118, 119 extending between opposite edges of arm members 121-3 and 121-4. Slots 126, 127 in outer wall 116 and inner wall 117, respectively, allow arm member 121-3, via pin 118, to slide along frame 111. Pin 119 rotates relative to outer wall 116 and inner wall 117 thereby maintaining arm member 121-4 in rotatable connection to frame 111. A similar arrangement controls scissor mechanism 120-2.

In operation, arm members 121-1 and 121-2, and 121-3 and 121-4 are able to rotate about their connected mid-points 123 and 124 while the two arm members 121-1 and 121-3 slide along slots 126, 127 in frame 111 and slot 128 in support member 130-1, respectively, permitting the entire scissor mechanism 120-1 to flatten into the elevated state (the same is true of scissor mechanism 120-2). The opposite operation takes place when moving the overhead storage apparatus 100 into a lowered state.

FIGS. 5A through 5C show a spring-biased tensioner mechanism 130 according to the embodiments of the present invention. The spring-biased tensioner mechanism 130 includes spools 155-1, 155-2, axle 160, pulleys 165-1, 165-2 and flat springs 170-1, 170-2. The spring-biased tensioner mechanism 130 is configured to retain the overhead storage apparatus 100 in an elevated position while permitting a user to lower the overhead storage apparatus 100 by means for a modest downward force. The spring-biased tensioner mechanism 130 is further configured to maintain the overhead storage apparatus 100 in a lowered position until a user applies a modest upward force returning the overhead storage apparatus 100 to its elevated position. While not shown, the frame 111 and/or floor 112 may include one or more handles allowing a user to easily grip the overhead storage apparatus 100 to lower and raise the same.

FIGS. 5A through 5C show a spring-biased tensioner mechanism 130 according to the embodiments of the present invention. The spring-biased tensioner mechanism 130 includes spools 155-1, 155-2, axle 160, pulleys 165-1, 165-2 and flat springs 170-1, 170-2. The spring-biased tensioner mechanism 130 is configured to retain the overhead storage apparatus 100 in an elevated position while permitting a user to lower the overhead storage apparatus 100 by means for a modest downward force. The spring-biased tensioner mechanism 130 is further configured to maintain the overhead storage apparatus 100 in a lowered position until a user applies a modest upward force returning the overhead storage apparatus 100 to its elevated position. While not shown, the frame 111 and/or floor 112 may include one or more handles allowing a user to easily grip the overhead storage apparatus 100 to lower and raise the same.

FIGS. 5A through 5C show a spring-biased tensioner mechanism 130 according to the embodiments of the present invention. The spring-biased tensioner mechanism 130 includes spools 155-1, 155-2, axle 160, pulleys 165-1, 165-2 and flat springs 170-1, 170-2. The spring-biased tensioner mechanism 130 is configured to retain the overhead storage apparatus 100 in an elevated position while permitting a user to lower the overhead storage apparatus 100 by means for a modest downward force. The spring-biased tensioner mechanism 130 is further configured to maintain the overhead storage apparatus 100 in a lowered position until a user applies a modest upward force returning the overhead storage apparatus 100 to its elevated position. While not shown, the frame 111 and/or floor 112 may include one or more handles allowing a user to easily grip the overhead storage apparatus 100 to lower and raise the same.

FIGS. 5A through 5C show a spring-biased tensioner mechanism 130 according to the embodiments of the present invention. The spring-biased tensioner mechanism 130 includes spools 155-1, 155-2, axle 160, pulleys 165-1, 165-2 and flat springs 170-1, 170-2. The spring-biased tensioner mechanism 130 is configured to retain the overhead storage apparatus 100 in an elevated position while permitting a user to lower the overhead storage apparatus 100 by means for a modest downward force. The spring-biased tensioner mechanism 130 is further configured to maintain the overhead storage apparatus 100 in a lowered position until a user applies a modest upward force returning the overhead storage apparatus 100 to its elevated position. While not shown, the frame 111 and/or floor 112 may include one or more handles allowing a user to easily grip the overhead storage apparatus 100 to lower and raise the same.

Figure 7A:
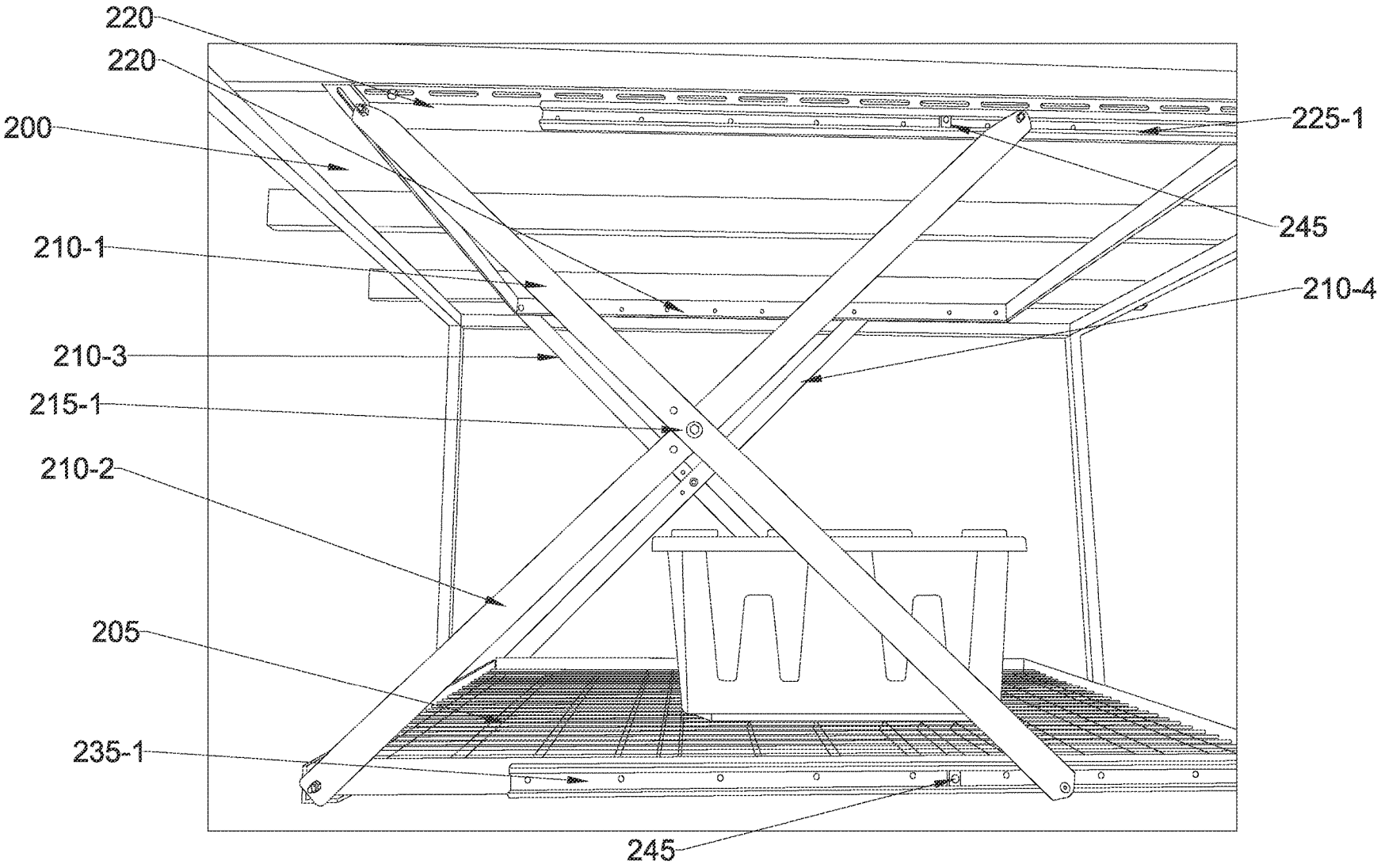
Figure 7B:
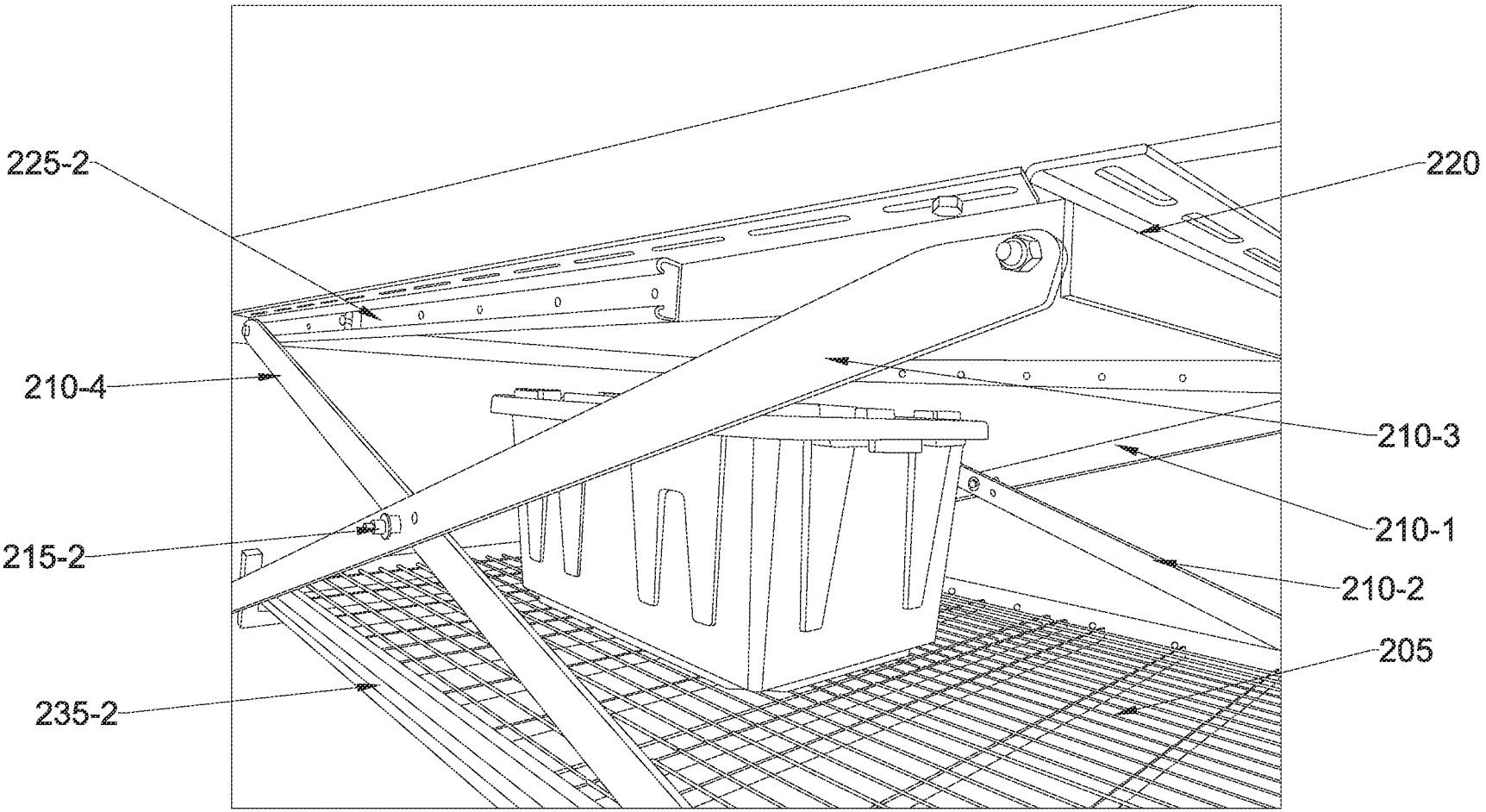
Figure 7C:
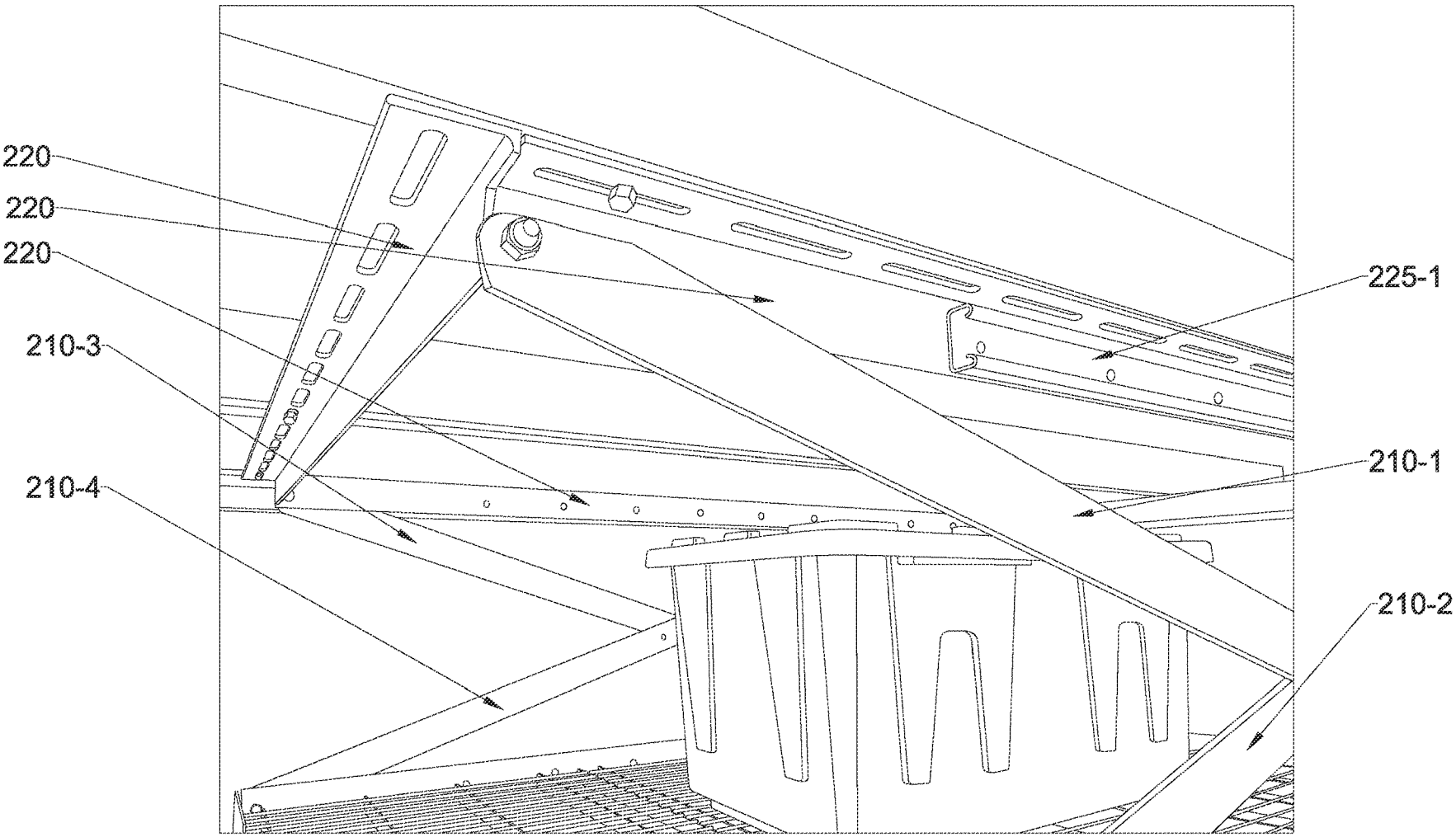
Figure 7D:
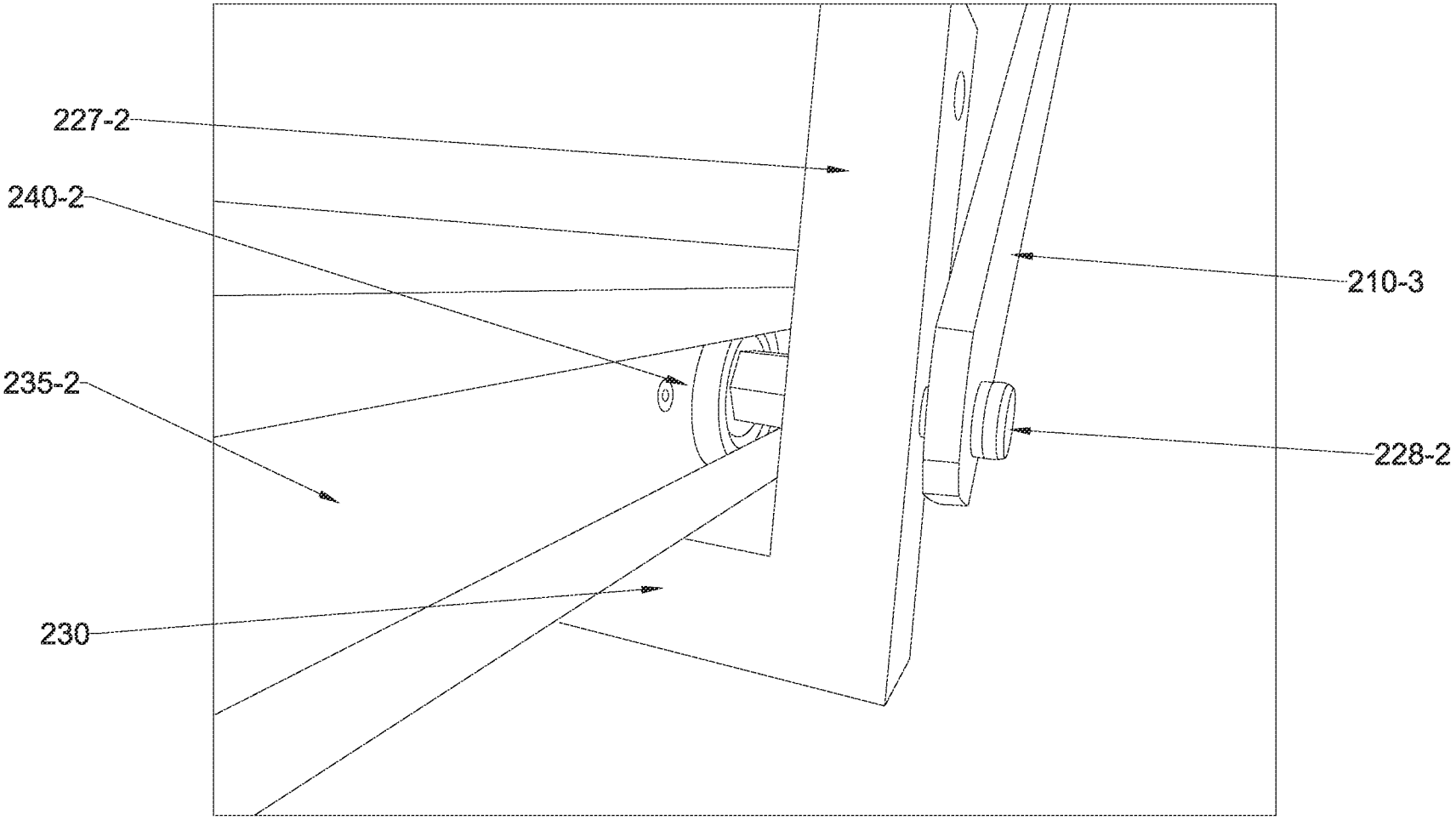
Figure 7E:
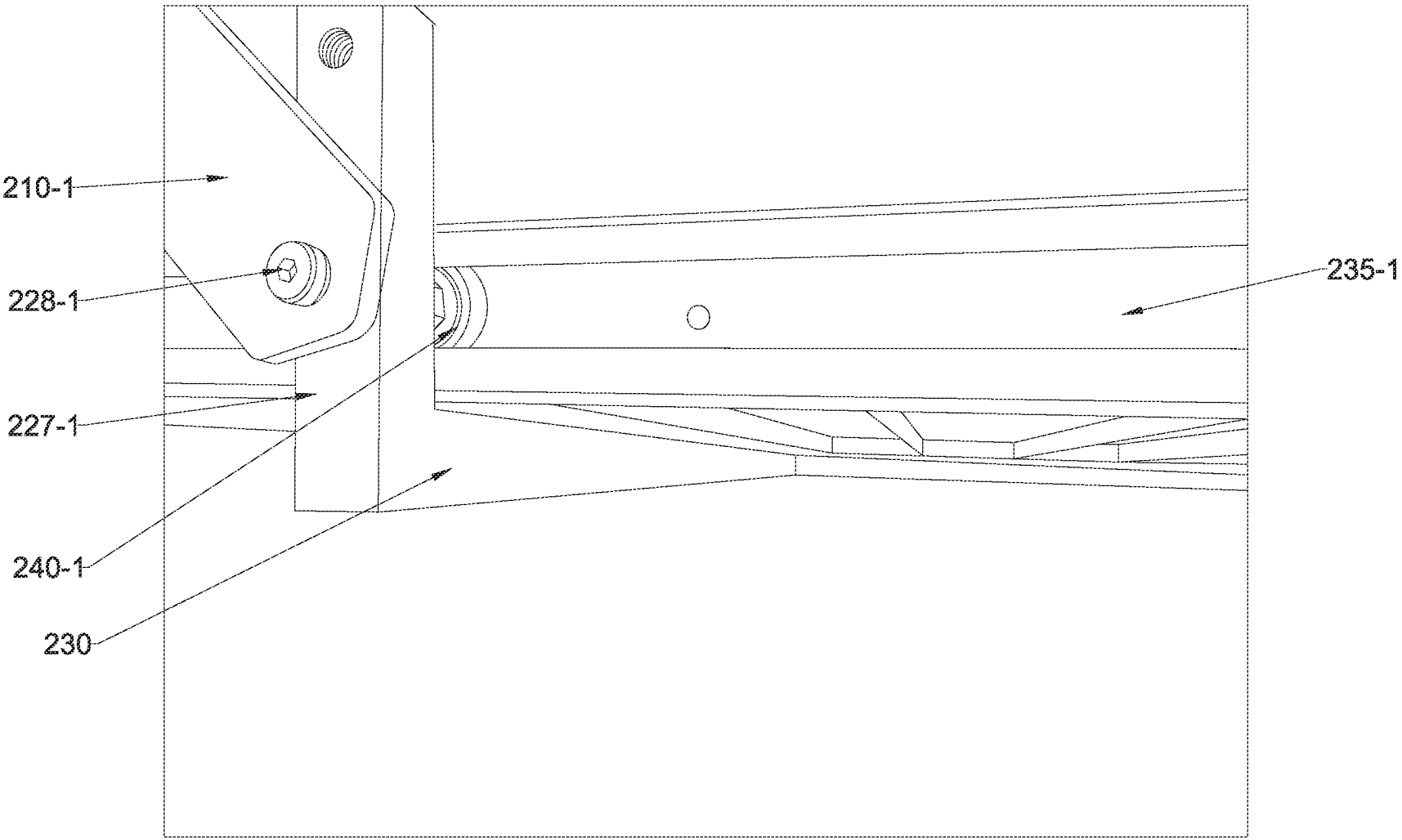
Figure 7F:
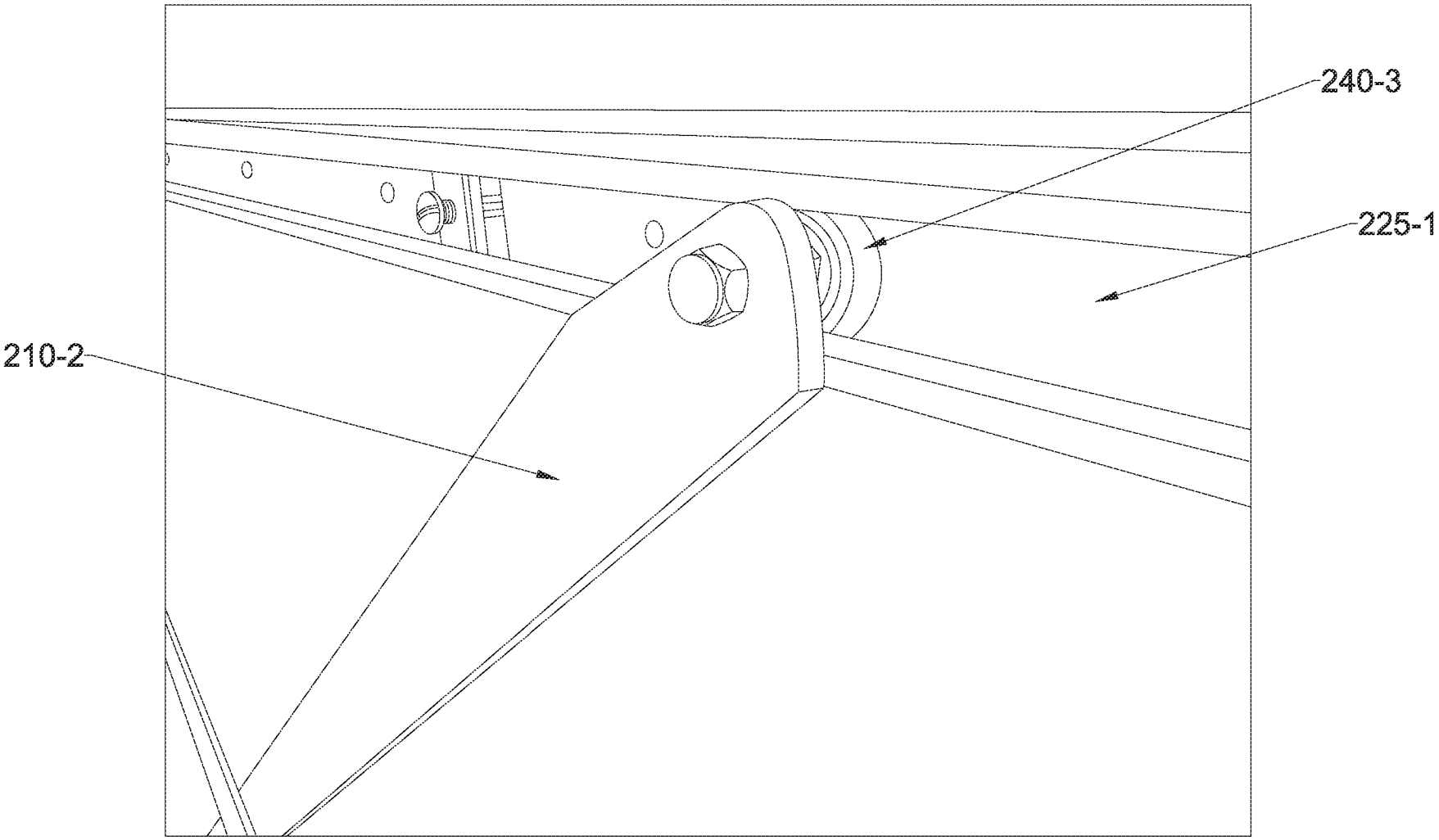

FIGS. 7A through 7H show a second embodiment of an overhead storage apparatus 200 according to the embodiments of the present invention. FIG. 7A shows a side view of the overhead storage apparatus 200 comprising broadly a lower support platform for goods 205, a scissor mechanism comprising two pairs of flat bars 210-1 to 210-4 with each pair of flat bars 210-1 and 210-2, and 210-3 and 210-4 attached at mid-points 215-1 and 215-2 to each other. One upper end of flat bars 210-1 and 210-3 are rotatably attached to an upper support member 220, attachable to a rigid overhead support (e.g., rafters) while lower ends of flat bars 210-2 and 210-4 are rotatably attached to said lower support platform 205. Opposite ends of flat bars 210-2 and 210-4 slidably engage upper guide rails 225-1 and 225-2 via wheels. Opposite ends of flat bars 210-1 and 210-3 attach to vertical members 227-1 and 227-2 of U-shaped cross-beam 230. The attachment of the flat bars 210-1 and 210-3 to the U-shaped cross-beam 230 further serves to slidably attach the U-shaped cross-beam 230 to lower guide rails 235-1 and 235-2.

The attachment of the flat bars 210-1 and 210-3 to the U-shaped cross-beam 230 is accomplished with a nut, bolt, and wheel or ball bearing arrangement 228-1 and 228-2. Wheels 240-1 and 240-2 slide along the lower guide rails 235-1 and 235-2. Similar wheels (only wheel 240-3 is shown) allow the flat bars 210-2 and 210-4 to slide along upper guide rails 225-1 and 225-2. Stops 245 prevent the lower support platform 205 from lowering beyond a threshold level.

Figure 7G:
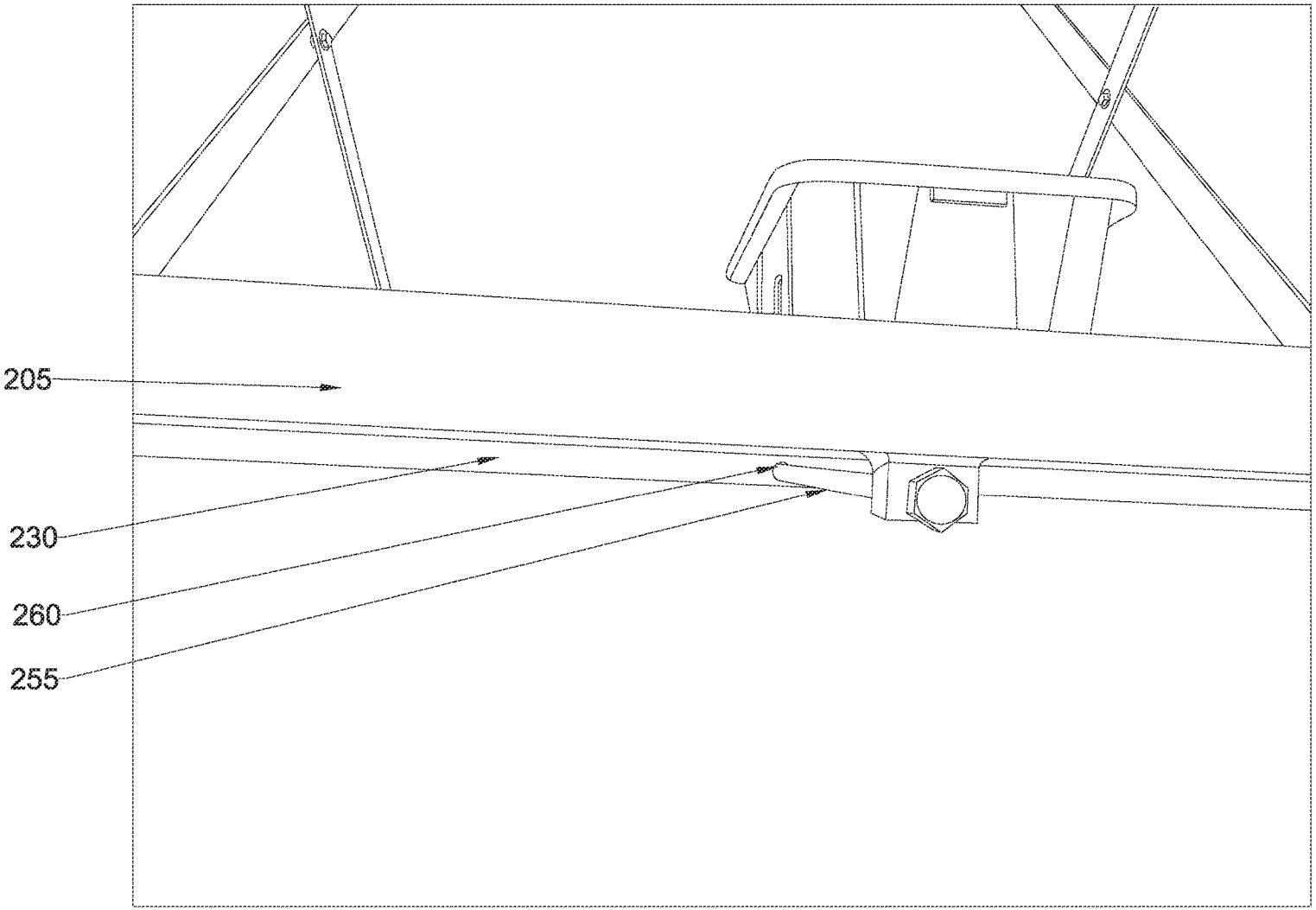
Figure 7H:
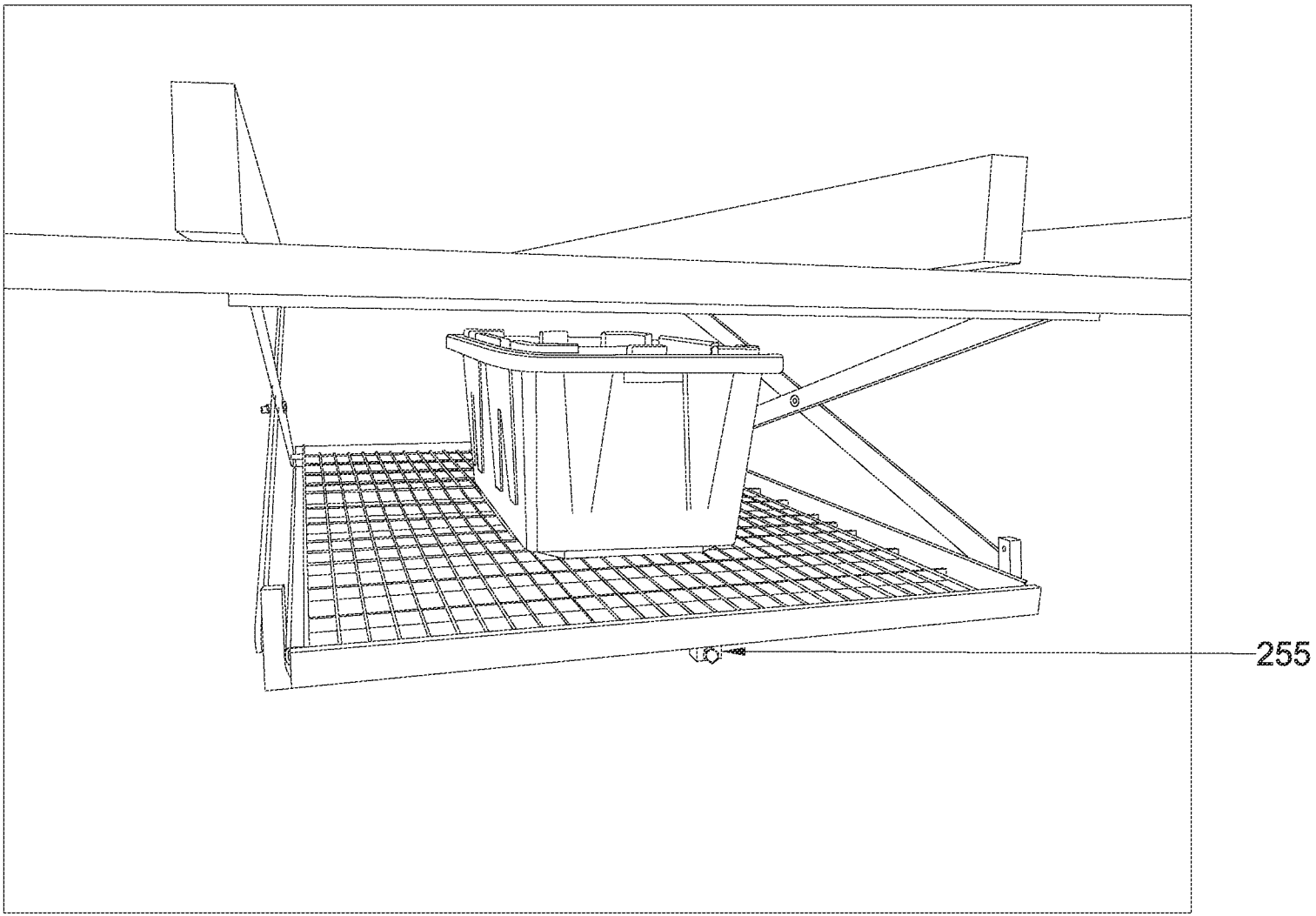
Figure 71:
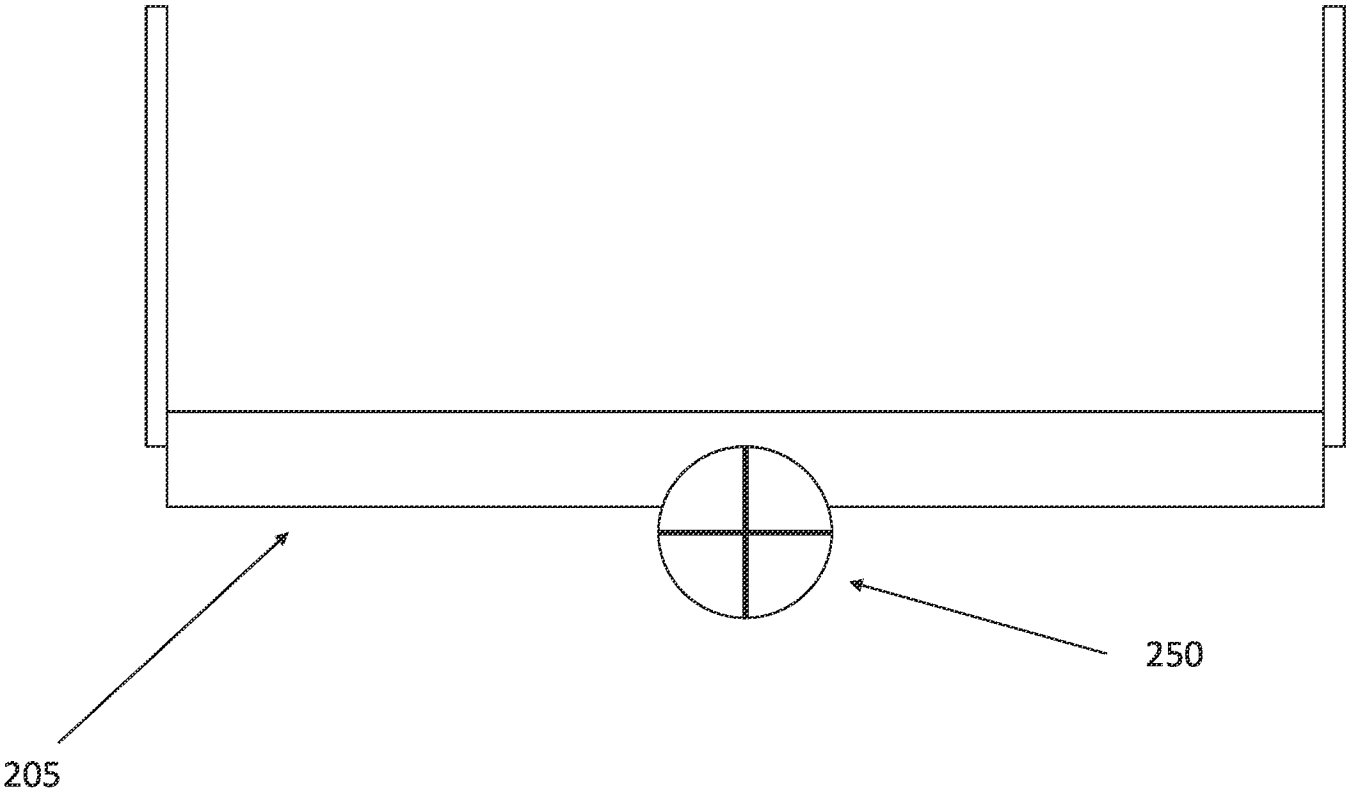

FIGS. 7G and 7H show rear and front views, respectively, of the overhead storage apparatus 200. With this second embodiment, the overhead storage apparatus 200 may be lowered and raised using a wheel 250 shown in FIG. 7I. The wheel 250, as detailed below, turns a threaded rod 255 which intersects, and threadedly engages a threaded opening 260 in, the U-shaped cross-beam 230 extending beneath the lower support platform 205. As the threaded rod 255 is turned by means of wheel 250 connected thereto, the U-shaped cross-beam 230 is forced to move via the wheels 240-1 and 240-2 sliding within lower guide rails 235-1 and 235-2 thereby raising or lowering the support platform 205. In one embodiment, turning the wheel 250 clockwise raises the lower support platform 205 and turning the wheel 250 counter-clockwise lowers the lower support platform 205. Means other than the wheel 250 may be used to turn the threaded rod 255 such as a crank handle, power tool, etc.

The components used to build the overhead storage apparatuses 100 and 200 may be fabricated of any number of materials including but not limited to alloys, polymers, metals, composites, plastics and combinations thereof. The components may be fabricated using any number of techniques including but not limited to machining, molding, casting, additive manufacturing and combinations thereof.

The components may be attached to one another and an overhead rigid structure using any number of fasteners including but not limited to pins, screws, nails, rivets, anchors, adhesives, magnets and combinations thereof.

Although the invention has been described in detail with reference to several embodiments, additional variations and modifications exist within the scope and spirit of the invention as described and defined in the following claims.

We claim:

1. An overhead storage apparatus comprising:

a platform;

a pair of spaced scissor mechanisms, each scissor mechanism having a first rotatable point of attachment to said platform and a second translatable point of attachment to said platform, each of said pair of scissor mechanisms comprising one or more pairs of intersecting arms; and a spring-biased tensioner mechanism including a pair of spools, pulleys and flat springs, and an axle, each of said flat springs extending between one of said pulleys on opposite edges of said platform to an intersection point of two arms of one of said scissor mechanisms, said spring-biased tensioner mechanism extending between opposite edges of said platform and configured to maintain said platform in an elevated state when access to said stored items is not desired and a lowered state when access to said stored items is desired, said spring-biased tensioner mechanism configured to allow a human to manually lower said platform from said elevated state to said lowered state and manually raise said platform from said lowered state to said elevated state.

2. The overhead storage apparatus of claim 1 wherein said platform comprises a frame and floor.

3. The overhead storage apparatus of claim 1 further comprising a support member attached to each of said spaced scissor mechanisms, said support members configured to attach to a rigid overhead structure.

4. An overhead storage apparatus comprising:

an upper rigid support;

a lower support platform;

a U-shaped cross-beam with a horizontal portion extending beneath said lower support platform and vertical members extending upward form opposite ends of said horizontal portion proximate outer edges of said lower support platform;

an upper pair of spaced guide rails joined to said upper rigid support and a lower pair of spaced guide rails joined to said lower support platform;

a pair of spaced scissor mechanisms, each scissor mechanism formed of a first bar and second bar rotatably attached at mid-points, one end of said first bar of each scissor mechanism slidably attached to said upper pair of guide rails, one end of said second bar of each scissor mechanism attached to one of said vertical members of said U-shaped cross-beam via an elongated member, said elongated member extending through said U-shaped cross-beam and attaching to a wheel serving to slidably attach said cross-beam to said lower guide rails; and a threaded rod extending through a threaded opening in said cross-beam such that turning said threaded rod raises and lowers said lower support platform via said scissor mechanism.

5. The overhead storage apparatus of claim 4 further comprising a wheel for turning said threaded rod.

6. The overhead storage apparatus of claim 4 wherein said one end of said first bar of each scissor mechanism is slidably attached to said upper pair of guide rails using wheels and said U-shaped cross-beam is slidably attached to said lower guide rails using wheels.

* * * * *